US005673583A

United States Patent [19]

Mazzolo et al.

[11] Patent Number: 5,673,583

[45] Date of Patent: Oct. 7, 1997

[54] FAST ROLLING BLOCK

[75] Inventors: Esterino Mazzolo, Manzano; Ferruccio Tomat, Udine, both of Italy

[73] Assignee: Danieli & Co. Officine Meccaniche Spa, Buttrio, Italy

[21] Appl. No.: 716,548

[22] Filed: Sep. 19, 1996

[30] Foreign Application Priority Data

Sep. 22, 1995 [IT] Italy ..... UD95A0184

[51] Int. Cl.[6] ..... B21B 13/08; B21B 13/12

[52] U.S. Cl. ..... 72/234; 72/235

[58] Field of Search ..... 72/199, 226, 234, 72/235, 237; 29/897.3, 897.31, 897.312, 897.32

[56] References Cited

U.S. PATENT DOCUMENTS 3,945,234 3/1976 Steinbock ..... 72/235

FOREIGN PATENT DOCUMENTS 0165673 12/1985 European Pat. Off. .
0659493 6/1995 European Pat. Off. .
970102 8/1958 Germany .
9320960 10/1993 WIPO .

*Primary Examiner*—Lowell A. Larson
*Assistant Examiner*—Rodney A. Butler
*Attorney, Agent, or Firm*—Antonelli, Terry, Stout & Kraus, LLP.

[57] ABSTRACT

Fast rolling block (10) employed in a compact rolling line for long products such as bars, round bars, wire rod and analogous products, the fast rolling block (10) comprising rolling mill stands (11) arranged in sequence with pairs of rolls (13) having alternate axes and installed alternately opposite to each other on a base (14), the base (14) comprising at least one horizontal base plate (15) extending parallel to the horizontal plane containing the rolling axis (12) and comprising also transverse plate elements (17) spaced apart and bearing on their upper edge (20) elements (19) for installation of the rolling mill stands (11), there being included longitudinal connecting elements (16), each transverse plate element (17) having a minimum width ("L") equal to 70% of the width of the horizontal base plate (15), the longitudinal connecting elements (16) extending between one transverse plate element (17) and the adjacent one.

16 Claims, 3 Drawing Sheets

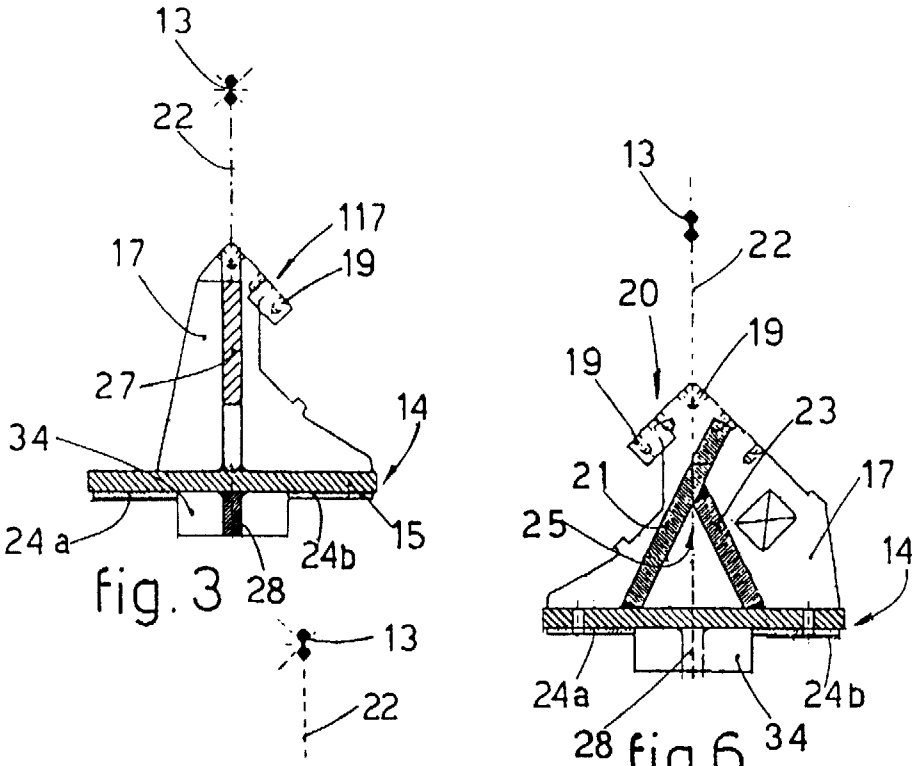
fig. 3
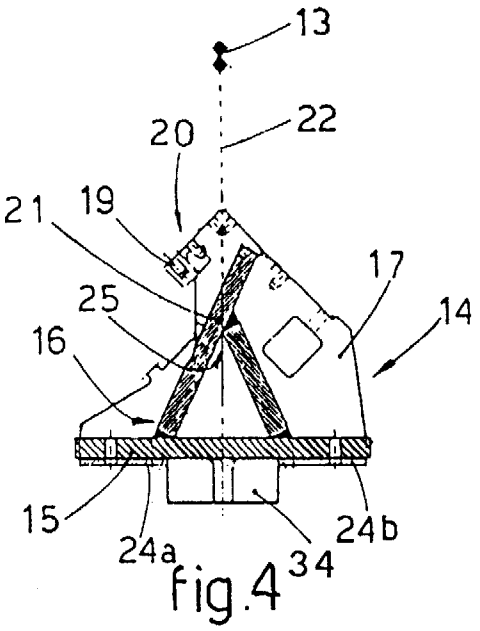
fig. 4
fig. 6
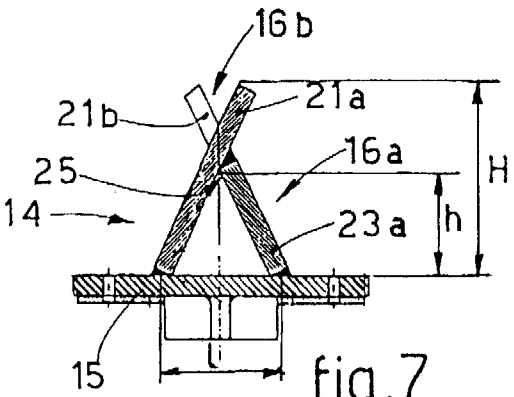
fig. 7
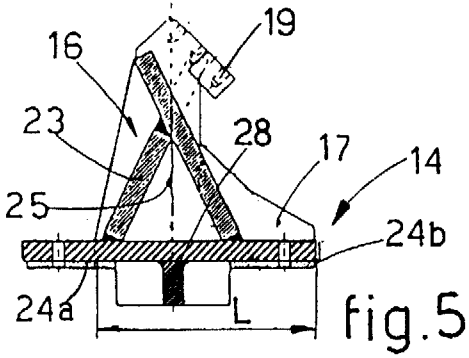
fig. 5

FAST ROLLING BLOCK

BACKGROUND OF THE INVENTION

This invention concerns a fast rolling block.

The fast rolling block according to the invention is used at least for the semi-finishing and finishing passes in compact rolling plants which produce long products such as bars, round bars and wire rod or other analogous types of product.

In compact rolling lines producing long products such as bars, wire rods and round bars, the state of the art discloses the use of fast rolling blocks at least for the passes of semi-finishing and finishing the rolled product.

These fast rolling blocks normally comprise from two to ten rolling mill stands having alternate axes at 90° to each other with the processing rolls installed as cantilevers.

These rolling mill stands are installed on a common base which extends longitudinally along an axis substantially parallel to the rolling axis.

The state of the art, such as the documents U.S. Pat. No. 3,336,781 and U.S. Pat. No. 3,610,014 for instance, has disclosed installation lay-outs which have the stands arranged on one and the same side of the base.

This lay-out, however, requires a very complex and heavy base structure to balance the structural imbalances involved, owing also to the great masses and high dynamic loads which the fast block has to withstand in particular during the passage of the product being rolled.

DE-A-970.203 and an article taken from the "Iron and Steel Engineer", pages 65–67 of September 1978 disclose a constructional lay-out which provides for the installation of the successive stands alternately on one side and on the other side of the common base.

These embodiments disclose a base structure in the form of a continuous pedestal shaped as an overturned "V", on which the stands are directly installed alternately in opposed positions.

This type of structure improves the static balance of the structure and its resistance to dynamic loads, but this lay-out suffers just the same from a plurality of structural problems such as, in particular, the lack of longitudinal vertical compactness of the base along the vertical line defined by the vertex of the overturned "V" and also the lack of enough structural rigidity.

Moreover, this lay-out entails a high level of noise during working owing to the occurrence of resonance of the sound within the closed space defined by the pedestal.

EP-A-165.673 discloses a fast rolling block which comprises a supporting structure defined by a horizontal base plate extending lengthwise substantially parallel to the rolling axis and associated at a median position with a continuous vertical plate.

This vertical plate, which together with the horizontal base plate defines a supporting structure forms substantially as an overturned "T" supports supporting plates welded in a transverse position at intervals apart and arranged alternately on one side and the other side of the base.

These supporting plates have the purpose of the installation of the rolling stands in alternate opposed positions.

This embodiment has been found rather efficient in solving the problems of structural rigidity, resistance to dynamic loads and the level of noise occurring in the state of the art.

However, this embodiment too has not been found fully satisfactory as regards the resistance to longitudinal deflections and torsional forces which the base structure has to withstand both in the static phase of storage, conveying and handling of the fast block and in the dynamic phase during the working conditions of the fast block.

It is known that a fast block of this type normally has a weight which, in relation, to the base, reaches 15.000 to 23.000 kgs., whereas it may reach overall 65.000 to 75.000 kgs. or more.

It is also known that even slight longitudinal and/or torsional deflections of the base, in view of the modest dimension and the great speed of the product being processed between the stands of the fast block, the speed being of the order of 120 to 160 meters per second, cause accentuated unfavourable results on the linearity of the rolling axis and therefore on the quality of the finished product and also on the working life of the machine and rolls.

It has been found that this base structure of the fast block is especially sensitive to longitudinal deformations along the direction of the loads, especially in the case of long periods of stoppage of the machine in storage, in the case of handling and in the case of transport.

This structure is also especially sensitive to twisting deformations during the periods of storage, lifting and transporting of the fast block.

In particular, during the steps of lifting the fast block, an imbalance of forces on one of the engagement points or else a wrong handling or an accident at the handling device have a substantial effect on the base and cause longitudinal deflections and twists which then have an effect on the proper working conditions of the fast block.

The increase of the working speed and the need to ensure always higher parameters of quality make unacceptable the values of bending and twisting which characterise the bases of the state of the art and have urged business men in this field to search for new embodiments which give greater assurances of resistance and rigidity.

SUMMARY OF THE INVENTION

The present applicants have designed, tested and embodied this invention to overcome this problem of the state of the art and to achieve further advantages.

The purpose of this invention is to provide a base for a fast rolling block which is characterised by its rigidity and its resistance to longitudinal deformations and to torsional deflections, especially during the phases of storage, handling and lifting of the fast block.

The fast rolling block according to the invention comprises pairs of rolls installed as cantilevers with alternate axes and positioned in sequence and fitted to the base at alternately opposed positions.

The base comprises a horizontal base plate which extends longitudinally and substantially parallel to the rolling plane at least along the whole length of the fast block.

Transverse stiffening and supporting plates are solidly fixed upon the horizontal base plate and are distanced from each other and are used also for installation of the rolling stands alternately on one side and on the other side of the base.

According to the invention each of these transverse plates has a width which covers at least 70% of the width of the horizontal base plate.

These transverse plates advantageously have a width substantially equal to or slightly less than the width of the horizontal base plate.

According to the invention a plurality of longitudinal connecting elements, which are substantially equal to each other, are solidly fixed between each pair of adjacent transverse plates; these longitudinal connecting elements are also secured to the horizontal base plate.

According to the invention each of the longitudinal connecting elements comprises a first upwardly extending longitudinal plate inclined in relation to the horizontal base plate by a desired value in relation to the vertical and positioned offset from the median plane of the horizontal base plate.

A second upwardly extending longitudinal plate is associated with the first upwardly extending longitudinal plate and is also inclined and positioned offset from the median plane of the horizontal base plate and on the opposite side of that plane from the first upwardly extending longitudinal plate so as to define a form of section which at least comprises an overturned "V".

According to the invention the zone of connection between the first and second upwardly extending longitudinal plates lies in the vicinity of the median vertical plane of the horizontal base plate.

In a first embodiment of the invention the second upwardly extending longitudinal plate is associated with the first upwardly extending longitudinal plate at a desired intermediate point thereof so as to define a longitudinal connecting element having an asymmetrical section and a form substantially like a "λ" defined by the extending of one of the sides of the overturned "V" in a straight line.

In the embodiment of the base according to the invention, adjacent asymmetrical connecting elements are installed alternately on opposite sides to each other according to the side on which the relative rolling stand is installed.

The part of the first upwardly extending longitudinal plate which extends upwards from the overturned "V" shaped conformation, alternately for one segment on one side of the base and for the successive segment on the other side, has a multiple of purposes.

A first purpose is to provide a structural reinforcing action for the base.

A further purpose is to permit the sliding and discharge of dirt downwards, thus facilitating the operations of discharge, cleaning and re-adaptation of the fast rolling block after each pass.

A further purpose is to reduce the resonance of sound during working, thus reducing the level of sound.

According to a variant the first and second upwardly extending longitudinal plates are connected at their ends at the median vertical plane of the horizontal base plate. In this case the connecting element comprises a further element which extends upwards from the connecting zone so as to define a form of section of the connecting element, this form being substantially symmetrical and like an overturned "Y".

This further element may consist of a third vertical plate associated with the first and second longitudinal plates at the vertex of the overturned "V" or may consist of the extension in a vertical direction of one of the two sides of the overturned "V".

The basic conformation at least as an overturned "V" of the longitudinal connecting elements is made structurally continuous by the solid connection carried out with the transverse plates.

This conformation as a structurally continuous overturned "V" and the solid connection to the transverse plates provides the base with a great structural rigidity in relation to longitudinal deformations and in relation to twisting deformations.

Moreover, this conformation divides the base longitudinally into a plurality of single beam elements solidly connected to each other.

This embodiment provides a base structured with a plurality of base elements and not with one single continuous element as conventionally included in the bases of the state of the art.

According to a variant of the invention two longitudinal reinforcing plates extending advantageously along the whole length of the horizontal plate are included below the horizontal plate and advantageously in a position symmetrical in relation to the median axis of the horizontal plate.

These longitudinal reinforcing plates provide the base with further rigidity in relation to the longitudinal bends which may affect the base during the phases of storage, handling and transport.

In the configuration of the base according to the invention the ideal prolongation of the upwardly extending longitudinal plates forming the connecting elements lies within the longitudinal reinforcing plates positioned below the horizontal base plate.

This confers on the base a great rigidity and resistance to twisting.

According to the invention the base comprises a further stiffening element in the form of a continuous longitudinal plate positioned axially below the horizontal base plate and cooperating with a supporting platform of the fast rolling block according to the invention.

According to a further variant, further transverse stiffening elements are included in cooperation, with the lower continuous longitudinal plate and are anchored below the horizontal base plate at advantageously equal intervals.

It has been found that the improvement relating to the resistance to twisting of the base according to the invention is of about 80% to 90% as compared to a structure with a single central beam, whereas the improvement in terms of resistance to longitudinal bending is about 15% to 25%.

The terminal segments of the fast block not intended to support the rolling stands may comprise non-structural basic elements consisting of a central vertical plate and possibly employed for installation of channels for cables, etc. and/or other auxiliary elements.

BRIEF DESCRIPTION OF THE DRAWINGS

The attached figures are given as a non-restrictive example and show a preferred embodiment of the invention as follows:

FIG. 3 shows a section along the line A—A of FIG. 1;

FIG. 4 shows a section along the line B—B of FIG. 1;

FIG. 5 shows a section along the line C—C of FIG. 1;

FIG. 6 shows a section along the line D—D of FIG. 1;

FIG. 7 is a diagram of two consecutive connecting elements of an asymmetric type;

DETAILED DESCRIPTION OF THE PREFERRED EMBODIMENTS

Figure 1:
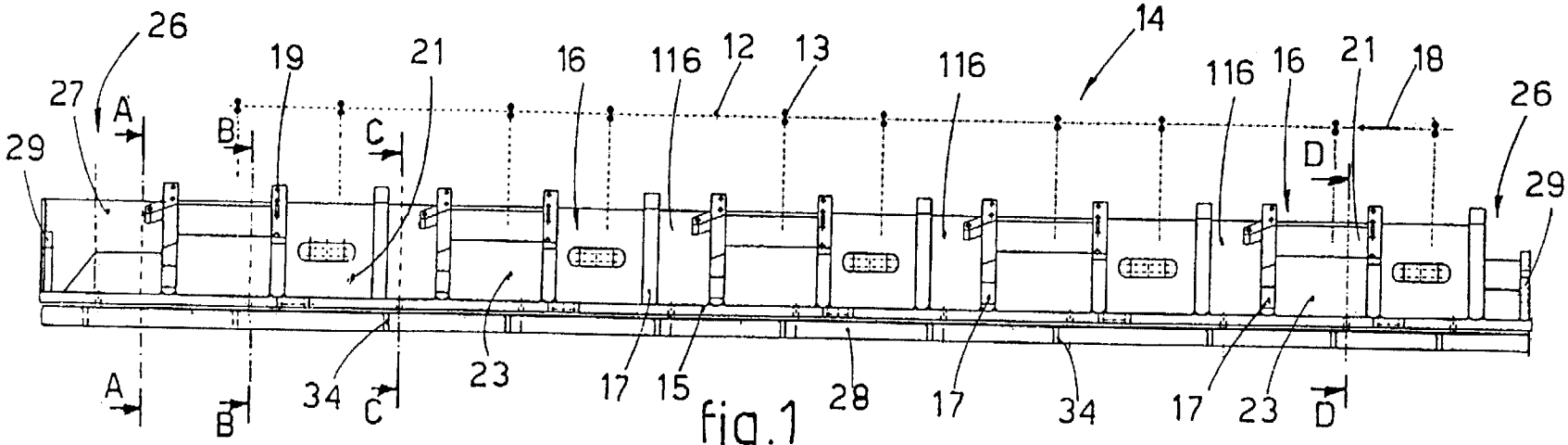
FIG. 1 shows a diagrammatic side view of a possible base for a fast rolling block according to the invention.
Figure 2:
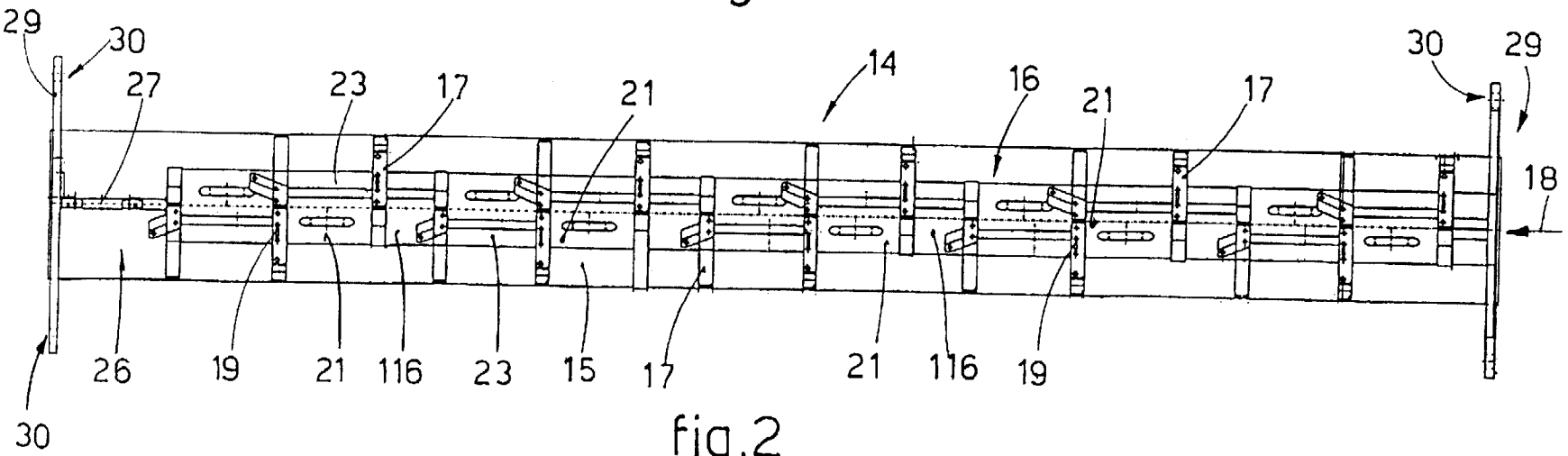
FIG. 2 is a plan view of the base of FIG. 1.

A base 14 for a fast rolling block 10 shown in FIGS. 1 and 2 is pre-arranged in this case for ten rolling mill stands referenced generally with 11 and installed in sequence on alternately opposed sides and bearing rolls fitted as cantilevers with their axes alternately at 90° to each other.

In this example the position of the rolling rolls is referenced with 13 and the rolling axis is referenced with 12, whereas the rolling direction is shown with 18.

The base 14 consists of a horizontal base plate 15 extending parallel to the horizontal plane containing the rolling axis 12 along at least the whole length of the fast rolling block 10.

A plurality of transverse supporting and stiffening plates 17 separated from each other are solidly secured to the horizontal base plate 15.

These transverse plates 17 act also as elements for installation of the rolling mill stands 11.

As can be seen in particular in FIG. 2 each intermediate transverse plate 17 bears on its upper supporting edges 20 elements 19 for installation of the relative rolling mill stands 11.

In this case each transverse plate 17 has a minimum width "L" (see FIG. 5) which covers at least 70% of the overall width of the horizontal base plate 15.

The inclusion of transverse plates 17 distributed at intervals along the horizontal base plate 15 and taking up a width much greater than half the width of the horizontal base plate 15 provides the base 14 with a very high rigidity both against longitudinal deformations and twisting deformations.

As can be seen in FIGS. 4 and 6 the transverse plates 17 advantageously take up substantially the whole width of the horizontal base plate 15.

Longitudinal connecting elements 16 are included between one transverse plate 17 and another and are solidly secured thereto, and all the connecting elements 16 in this case have the same asymmetrical form of their section and are installed alternately as counterparts to each other in relation to the side of installation of the relative rolling mill stand 11.

Each asymmetrical connecting element 16 comprises a first upwardly extending longitudinal plate 21 anchored to the horizontal base plate 15 in a direction inclined to the vertical and in a position offset from the median vertical plane 22 of the horizontal base plate 15.

Each longitudinal asymmetrical connecting element 16 comprises also a second upwardly extending longitudinal plate 23 having a shorter length and also inclined to and offset from the horizontal base plate 15 on the opposite side of the median plane 22 in relation to the first upwardly extending longitudinal plate 21.

The zone of connection 25 between the first 21 and second 23 upwardly extending longitudinal plates lies in the vicinity of the median plane 22 of the horizontal base plate 15.

In this case, the height "h" of the zone of connection above the horizontal base plate 15 is between 0.25 and 0.45 times, but advantageously between 0.30 and 0.38 times, the width of the horizontal base plate 15 (see FIG. 7).

In this case (see FIG. 7) the maximum height "H" of the first upwardly extending longitudinal plate 21 is between 0.60 and 0.80 times, but advantageously between 0.65 and 0.75 times, the width of the horizontal base plate 15.

Furthermore, the value of the distance between centres "l" as between the zone of connection of the first upwardly extending longitudinal plate 21 to the horizontal base plate 15 and the zone of connection of the second upwardly extending longitudinal plate 23 to the horizontal base plate 15 is between 0.25 and 0.40 times, but advantageously between 0.30 and 0.38 times, the width of the horizontal base plate 15.

The asymmetrical connecting elements 16 made structurally continuous by the inclusion of the transverse plates 17, in view of the "λ" conformation of their section and their alternately counterpart installation, provide a continuous overturned "V" associated with extensions provided in alternate positions.

In FIG. 7, which shows two adjacent asymmetrical connecting elements referenced respectively with **16*a* and 16*b*, it is possible to see how along the base 14 there becomes formed the structural continuous conformation of an overturned "V", whereas the inclusion of the respective first upwardly extending longitudinal plates referenced respectively with 21*a* and 21*b* defines extensions which affect alternately one side and the other side of the fast rolling block 10**.

This conformation of the base 14 as an overturned "V" provides the structure with a great rigidity against the longitudinal deformations and the twisting bends arising from stresses in the phases of storage, transport, lifting or other handling of the fast rolling block 10.

In the base 14 there are included longitudinal asymmetrical connecting elements 16 of the same length if associated with the inclusion of a rolling mill stand 11 and longitudinal asymmetrical connecting elements 116 of a reduced length where the rolling mill stand 11 is not included.

In this case, with reference to the rolling direction 18, the direction of installation of the longitudinal asymmetrical connecting elements 116 is the same as that of the element 16 which follows.

According to a variant which is not shown here, the longitudinal asymmetrical connecting elements have a symmetrical form of section substantially like an overturned "Y", which is obtained by associating a third vertical plate at the zone of connection 25 or else by the extension of one of the two longitudinal plates 21 or 23 in a vertical direction from the zone of connection 25.

In this case two longitudinal plates referenced respectively with **24*a* and 24*b* are included below the horizontal base plate 15 and advantageously arranged symmetrically on one side and the other side of the median plane 22; these longitudinal plates 24*a*, 24*b* provide the base 14** with great rigidity against longitudinal deformations.

In this example the extension of the first and second upwardly extending longitudinal plates 21, 23 defining the asymmetrical connecting elements 16 lies between the planes of the longitudinal plates **24*a*, 24*b* so as to provide the base 14 with the assurance of great resistance to bending stresses due, for instance, to the lifting and/or handling of the fast rolling block 10**.

Figure 8:
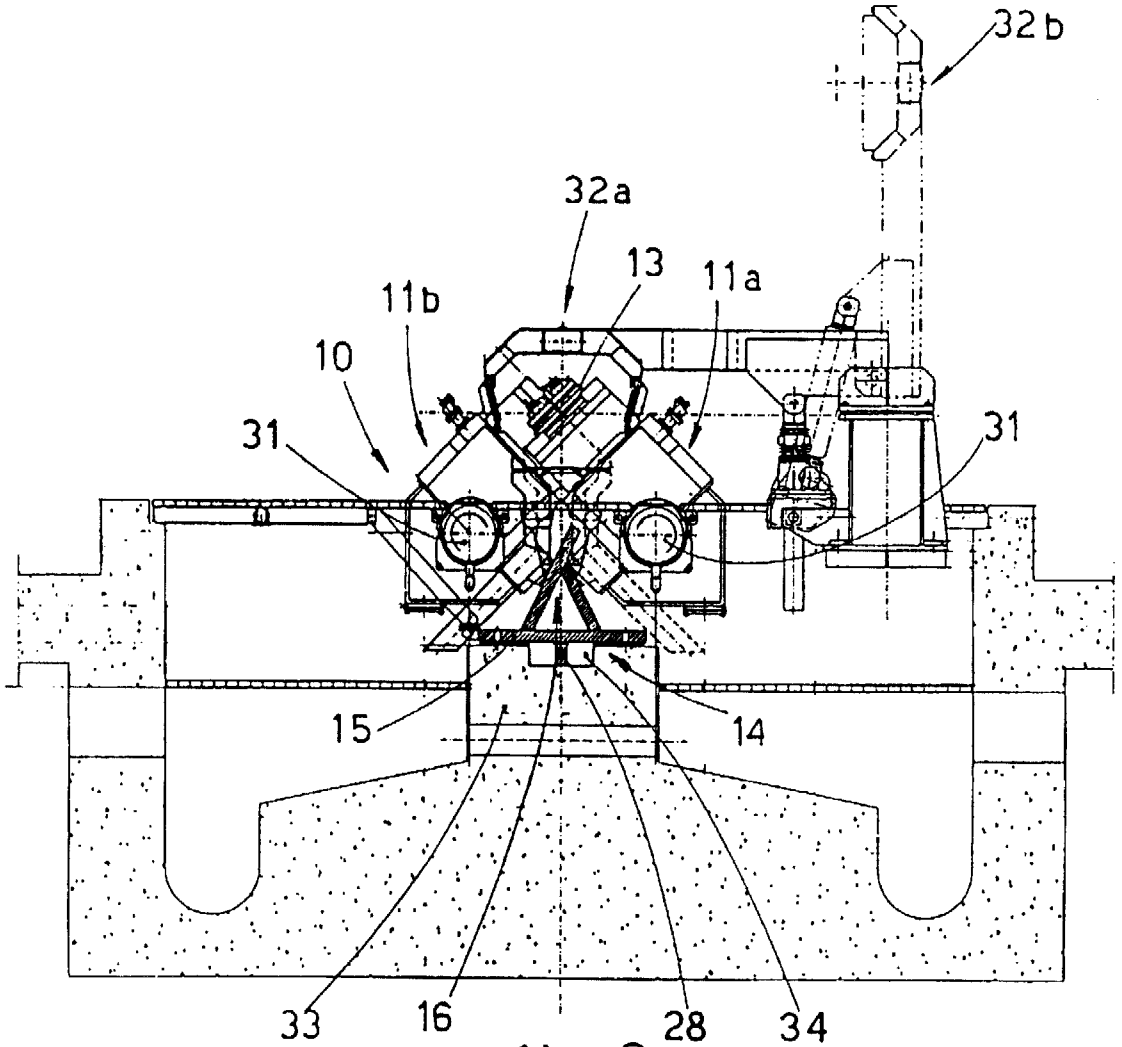
FIG. 8 shows a cross-section of the fast rolling block according to the invention.

In this case, a continuous longitudinal stiffening plate 28 is included below the horizontal base plate 15 and along the whole length thereof and is associated with a supporting platform 33 on which the fast rolling block 10 is located, (FIG. 8).

Further transverse stiffening elements 34 are included in cooperation with, and below, the horizontal base plate 15 and are arranged advantageously spaced equally part and have a height substantially equal to that of the continuous longitudinal stiffening plate 28.

Inlet and outlet elements 26 of the fast rolling block 10 do not include the connecting element 16 but comprise a central plate element 27 secured to the horizontal base plate 15; this central plate element 27 can be used for installation of a channel for cables and/or other auxiliary elements for the working of the fast rolling block 10.

Plates 29 which include holes 30 that can be used conventionally for the lifting and handling of the fast rolling block 10 are provided at the inlet and outlet of the fast rolling block 10.

FIG. 8 shows a cross-section of the fast rolling block 10 as a whole, in which can be seen at least partially two rolling mill stands 11*a* and 11*b* (only one pair of rolls 13 is visible) which are associated respectively with one side and the other side of the base 14.

That figure shows also shafts 31 which transmit conventionally the motion respectively to one side and the other side of the fast rolling block 10, and shows also a conventional removable cover illustrated in two positions, namely a working position 32*a* and an inactive position 32*b*.

We claim:

1. Fast rolling block employed in a compact rolling line for rolling long bars, round bars, wire rods and analogous products, the fast rolling block comprising: a base having at least one horizontal base plate extending parallel to a horizontal plane containing a rolling axis and transverse plate elements extending transversely to the base plate and to the rolling axis and being for installation of rolling mill stands, wherein each transverse plate element has a minimum width ("L") equal to 70% of the width of the horizontal base plate; a plurality of longitudinal connecting elements extending between one transverse plate element and the adjacent one; and a plurality of rolling mill stands arranged in sequence with pairs of rolls having alternate axes and installed alternately opposite to each other on the transverse plate elements.

2. Fast rolling block as in claim 1, in which the longitudinal connecting elements have a form of their section comprising at least an overturned "V".

3. Fast rolling block as in claim 1, in which the longitudinal connecting elements have a symmetrical form of their section like an overturned "Y".

4. Fast rolling block as in claim 1, in which each longitudinal connecting element comprises a first upwardly extending longitudinal plate fitted at an inclination to, and offset from, a median plane of the horizontal base plate, and a second upwardly extending longitudinal plate fitted at an inclination to, and offset from, that median plane on the opposite side to the first upwardly extending longitudinal plate.

5. Fast rolling block as in claim 1, in which a continuous longitudinal stiffening plate associated with a supporting platform of the fast rolling block is included below the horizontal base plate at least along a substantial part of the length of the horizontal base plate.

6. Fast rolling block as in claim 2, in which the longitudinal connecting elements have an asymmetrical form of their section like a "λ", this form being defined by a further extension, in a straight line, of one of the sides of the overturned "V".

7. Fast rolling block as in claim 6, in which the asymmetrical connecting elements are installed alternately as counterparts to each other in relation to the side of installation of the relative rolling mill stand.

8. Fast rolling block as in claim 3, in which the form of the section as an overturned "Y" is obtained by the inclusion of a third vertical plate associated with an vertex of the overturned "V" and extending upwards.

9. Fast rolling block as in claim 3, in which the form of the section as an overturned "Y" is obtained by the vertical upward extension of one side of an overturned "V" starting from the vertex of the overturned "V".

10. Fast rolling block as in claim 4, in which a zone of connection of the first upwardly extending longitudinal plate to the second upwardly extending longitudinal plate lies in the vicinity of the median plane of the horizontal base plate.

11. Fast rolling block as in claim 4, in which the maximum height ("H") of the first upwardly extending longitudinal plate is between 0.60 and 0.80 times the width of the horizontal base plate.

12. Fast rolling block as in claim 4, in which below the horizontal base plate (15) there are included two plates providing at least longitudinal reinforcement and stiffening and positioned respectively on one side and on the other side of the median plane.

13. Fast rolling block as in claim 10, in which the height ("h") of the zone of connection above the horizontal base plate is between 0.25 and 0.45 times the width of the horizontal base plate.

14. Fast rolling block as in claim 10, in which the value of the distance between centres ("l") of the zone of connection of the first upwardly extending longitudinal plate to the horizontal base plate and the zone of connection of the second upwardly extending longitudinal plate to the horizontal base plate is between 0.25 and 0.40 times the width of the horizontal base plate.

15. Fast rolling block as in claim 12, in which extensions of the first and second upwardly extending longitudinal plates of the connecting elements lie between the planes of the longitudinal plates for the purpose of at least torsional stiffening.

16. Fast rolling block as in claim 5, in which transverse stiffening elements advantageously separated by equal distances and having a height substantially equal to that of the continuous longitudinal stiffening plate are included below the horizontal base plate and in cooperation therewith.

* * * * *